US007963012B1

(12) United States Patent
Brasher et al.

(10) Patent No.: US 7,963,012 B1
(45) Date of Patent: Jun. 21, 2011

(54) TOOL FOR SEATING A GRIP ON THE SHAFT OF A GOLF CLUB

(75) Inventors: Justin Wesley Brasher, Longmont, CO (US); James W. Curry, Casper, WY (US); Michael J. Smith, Gilbert, AZ (US)

(73) Assignee: JMW Golf LLC, Scottsdale, AZ (US)

( * ) Notice: Subject to any disclaimer, the term of this patent is extended or adjusted under 35 U.S.C. 154(b) by 0 days.

(21) Appl. No.: 12/790,118

(22) Filed: May 28, 2010

(51) Int. Cl.
*B25B 27/22* (2006.01)

(52) U.S. Cl. ..... 29/270; 29/280; 29/244

(58) Field of Classification Search ..... 29/270, 29/244, 263, 255, 280, 278
See application file for complete search history.

(56) References Cited

U.S. PATENT DOCUMENTS

| | | | | |
|---|---|---|---|---|
| 5,429,706 | A | 7/1995 | Cresse et al. | |
| 5,687,464 | A * | 11/1997 | Marshall | 29/263 |
| 5,937,495 | A * | 8/1999 | Kuo | 29/256 |
| 6,266,859 | B1 * | 7/2001 | Hernandez | 29/256 |
| 6,308,390 | B1 * | 10/2001 | Sullivan | 29/275 |
| 6,363,596 | B1 * | 4/2002 | Reiter et al. | 29/278 |
| 6,449,823 | B2 * | 9/2002 | Krapp | 29/244 |
| 6,460,237 | B1 | 10/2002 | Tsiguloff | |
| 6,601,277 | B1 * | 8/2003 | Swanson | 29/256 |
| 6,775,891 | B1 | 8/2004 | Tsiguloff | |
| 6,910,252 | B2 * | 6/2005 | Draggie et al. | 29/263 |
| 7,100,255 | B1 * | 9/2006 | McNamee et al. | 29/275 |
| 7,658,368 | B2 * | 2/2010 | Laun | 254/18 |
| 2002/0010992 | A1 | 1/2002 | Carey et al. | |
| 2005/0119065 | A1 | 6/2005 | Bettencourt et al. | |

OTHER PUBLICATIONS

International Search Report in PCT Application No. PCT/US10/48262 dated Nov. 15, 2010, 3 pages.

* cited by examiner

*Primary Examiner* — Lee D Wilson
(74) *Attorney, Agent, or Firm* — Patton Boggs LLP

(57) ABSTRACT

The Golf Grip Seating Tool permits tapeless seating of a grip onto the shaft of a golf club by having the controllable application of compressed air expand the grip, as it is positioned onto the shaft of the golf club. The Golf Grip Seating Tool comprises an enclosing member having an axial bore with an open end and a closed end, a slot, and a convergent nozzle mounted medially in the closed end of the enclosing member. The open end of the grip goes over the open end of the golf club shaft and forms a seal to allow the compressed air applied via the nozzle in the enclosing member to expand the grip yet allow excess air to escape between the grip and the shaft as the grip controllably inflates at the distal end.

12 Claims, 4 Drawing Sheets

TOOL FOR SEATING A GRIP ON THE SHAFT OF A GOLF CLUB

FIELD OF THE INVENTION

The invention relates generally to the field of sports equipment, and more particularly to the seating of rubberized grips onto the shaft of golf clubs.

BACKGROUND OF THE INVENTION

Grips can be seated by applying double sided tape to the shaft of the golf club and sliding the grip over the taped area. Tapes are messy to apply since the strong adhesive dries quickly. To prevent the grip from immediately adhering to the tape as the grip is being positioned, the user is required to apply soapy water to the mouth of the grip to lessen some of the stickiness of the tape without dissolving it completely. There is little room for mistakes since too much soapy water makes the adhesive on the tape ineffective, and taking too long positioning the grip will lead to the adhesive drying before the grip is fully positioned. In addition to the mess and inconvenience, the grip must be left to dry for more than ten hours. Further, once the grip is adhered to the taped shaft, the grip cannot be readjusted without removing the grip and tape altogether, and repeating the seating process.

Grips can also be seated on the shaft of a golf club using an air pressure grip applying tool. However, these tools require a steep learning curve in order to determine the correct amount of air pressure to apply since there are no provisions for controlling the operation of the tool. Grips are manufactured from rubber and, due to memory of the rubber material, applying too much pressure can permanently stretch the grip, making the grip unusable. Additionally, during the application of compressed air, the air collects in the closed end of the grip, rapidly causing deformation of the closed end of the grip. Air compressors can blow air into the grip at a pressure of 30 psi to 200 psi (per square inch). Inexperience or inattentiveness of the operator of the tool can cause the full force of air into the grip, stretching it beyond repair.

For the above reasons, the seating of grips on the shaft of a golf club is time consuming, messy, and, therefore, largely left to the hands of experienced pro shop employees rather than purchasers of golf clubs or less skilled pro shop employees.

BRIEF SUMMARY OF THE INVENTION

The disclosed Tool For Seating A Grip On The Shaft Of A Golf Club (termed "Golf Grip Seating Tool" herein) permits tapeless seating of a grip by having the controllable application of compressed air expand the grip as it is positioned onto the shaft of the golf club. This enables the grip to slide effortlessly down the shaft. The Golf Grip Seating Tool comprises an enclosing member having an axial bore with an open end and a closed end, and a convergent nozzle having an open end and a closed end mounted medially in the closed end of the enclosing member. The first end of the convergent nozzle is insertable into the mating hole in the closed end of the grip, and the second end of the convergent nozzle is connected to an aperture formed in the closed end of the enclosing member, wherein the closed end of the enclosing member is connectable to a source of compressed air. The open end of the grip goes over the open end of the golf club shaft and forms a seal to allow the compressed air to expand the grip, yet allow excess air to escape between the grip and the shaft as the grip controllably inflates at the distal end. The closed end of the grip is insertable into the closed end of the enclosing member of the tool. Compressed air enters the tool through an aperture in the closed end of the tool and flows through a mating hole in the closed end of the grip. The compressed air flows into the shaft of the golf club, into the unexpanded grip, and fills those spaces until the grip expands and can slide freely down the shaft to be seated on the end of the shaft. The diameter of the enclosing member of the tool is selected to accommodate yet restrict the expansion of the grip. The slot running longitudinally along the axis of the enclosing member allows the diameter of the tool to increase with the increase in grip diameter as air is fed into the grip as well as handle grips with multiple diameter grip sizes without deforming the cylindrical shape of the grip. The longitudinal edges of the slot are beveled, whereby rotating the enclosing member increases the contact between an edge and the underlying grip to facilitate repositioning of the grip. The slot also facilitates heat exchange between ambient air and air in the grip to prevent air passing through the grip during seating from deforming the grip due to excessive heat. The enclosing member may be cylindrical, oval, or rectangular. The enclosing member of the Golf Grip Seating Tool may be manufactured from rubber. However, other materials including, but not limited to, synthetic rubber or plastic may be used, so long as the material can be shaped to form an enclosing member. Moreover, the material preferably will not chemically react to the material of the grip. As soon as the grip is fully seated on the shaft, the grip is ready for use.

DETAILED DESCRIPTION OF THE PREFERRED EMBODIMENT

Typical Grip Characteristics and Application Considerations

Most golf grips are made from rubber. A rubber grip has memory such that once the grip is stretched past an elastic limit, it maintains the stretched shape. Elasticity is the physical property of a material that allows the material to return to its original shape after the stress that made it deform is removed. Deformation is a change in the shape or size of an object due to an applied force, compressive forces, shear, bending, twisting, or torsion. As deformation occurs, internal inter-molecular forces arise which oppose the applied force. If the applied force is not too large, these forces may be sufficient to completely resist the applied force, allowing the object to assume a new equilibrium state and to return to its original state when the load is removed. A larger applied force may lead to a permanent deformation of the object or even to its structural failure.

Figure 4:
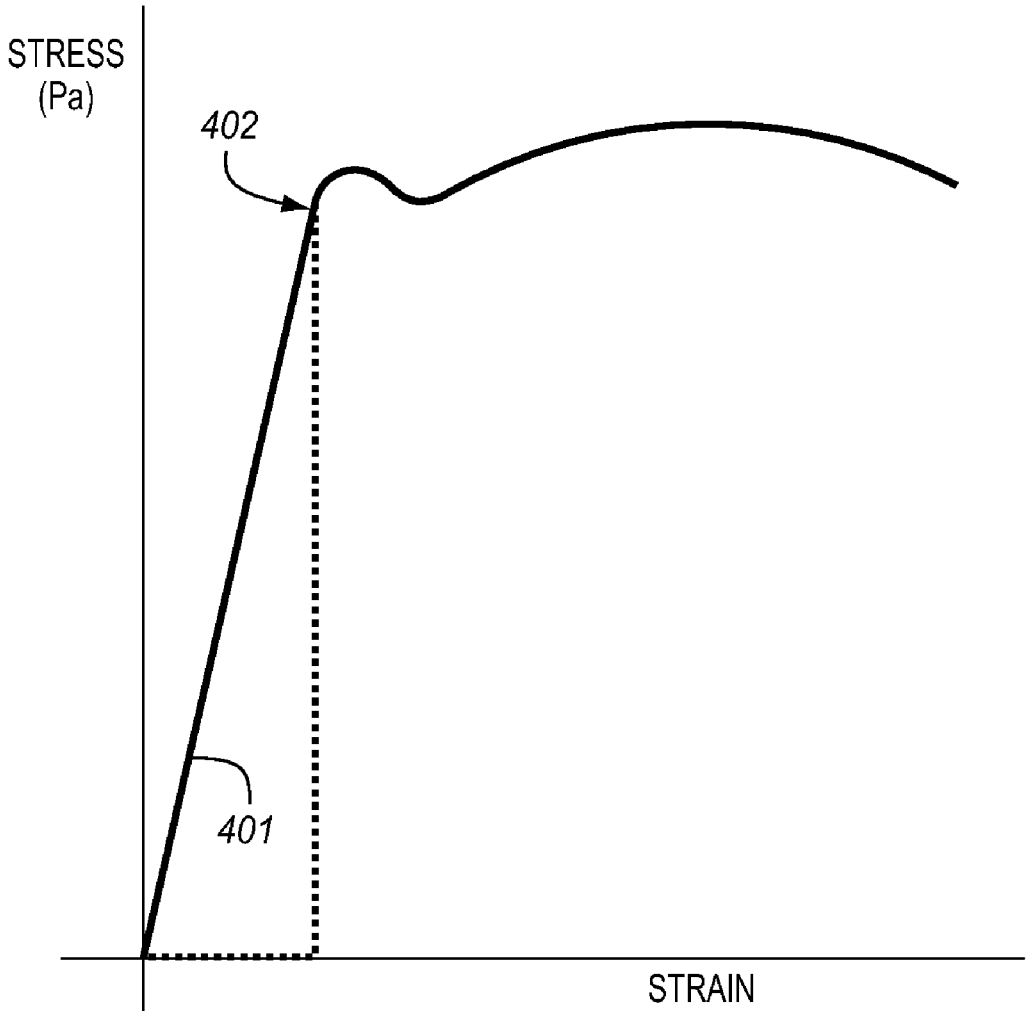
FIG. 4 is a stress strain curve of rubber.

FIG. 4 illustrates a stress-strain curve of rubber. The x-axis is strain and the y-axis is stress measured in Pascal. Rubber exhibits proportional stress to strain 401; that is, rubber obeys Hooke's law up to the elastic limit 402. Until the elastic limit, removal of stress will return rubber to its un-stretched form. After the elastic limit is reached 402, any continued stress results in permanent deformation.

A deformed grip no longer sits tightly on the shaft. A correctly seated grip is held in place by friction between the grip and the material enclosed by the grip. In exemplary embodiments, the enclosed material may be the uncovered or taped shaft of a golf club. When the grip is deformed, it is no longer in complete contact with the enclosed material; therefore, the grip will no longer stay stationary on the enclosed material.

As mentioned above, a rubber grip may deform due to stress. Additionally, heat may also cause deformation. The application of heat to stretched rubber causes the rubber to contract. The reason is that heating the rubber molecules increases the movement of the molecules. The molecules become less aligned as a result, and the rubber shrinks instead of expanding when it is heated. The molecules become more tangled and contract.

Golf Grip Seating Tool

The disclosed Golf Grip Seating Tool permits controlled and tapeless seating of a grip on the shaft of a golf club (or the shaft of any other device) by having the compressed air expand the grip as it is positioned onto the shaft of the golf club. This enables the grip to slide effortlessly down the shaft. The open end of the grip goes over the open end of the shaft and forms a seal to allow the compressed air to expand the grip, yet allow excess air to escape between the grip and the shaft. The diameter of the enclosing member of the tool is selected to accommodate yet restrict the expansion of the grip. The unexpanded grip is inserted into the enclosing member of the tool, and compressed air enters the tool through an aperture in the closed end of the enclosing member and flows through a mating hole in the closed end of the grip. The compressed air flows into the shaft of the golf club, into the unexpanded grip, and fills those spaces until the grip expands and can slide freely down the shaft to be seated on the end of the shaft.

Figure 1:
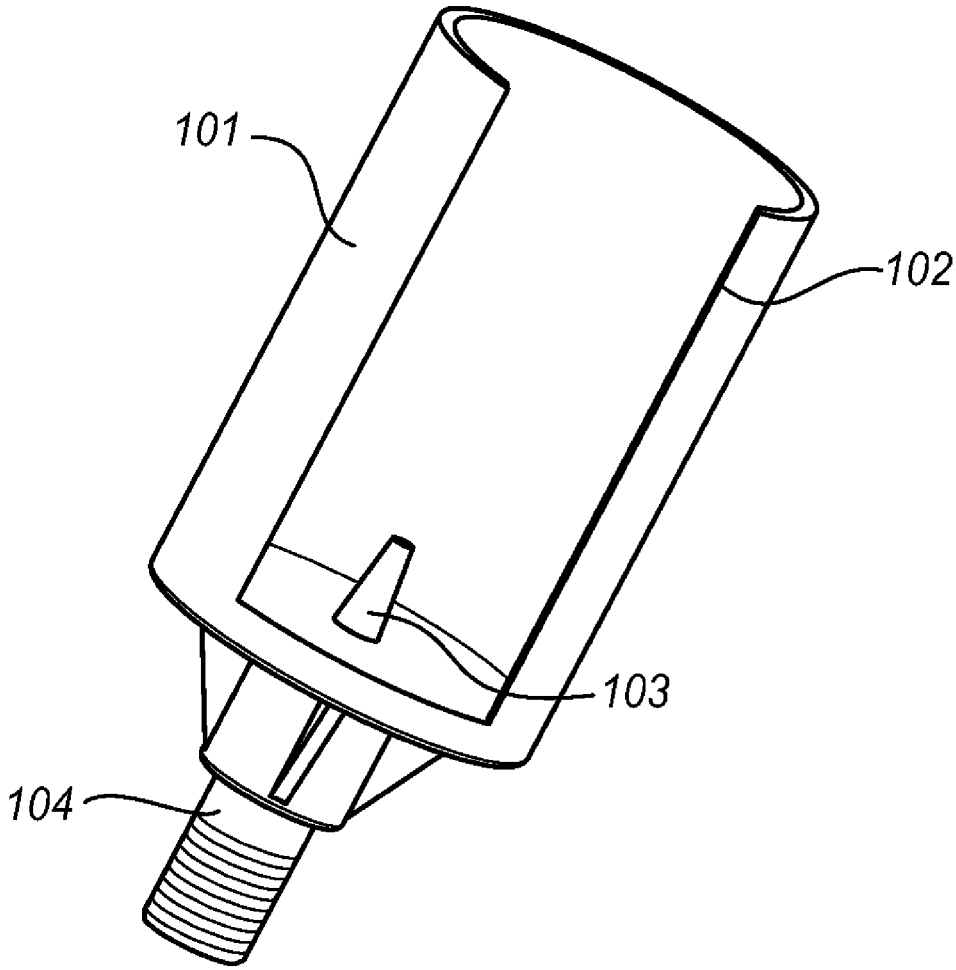
FIG. 1 is a schematic of a Golf Grip Seating Tool.

FIG. 1 shows a schematic of the Golf Grip Seating Tool. The Golf Grip Seating Tool comprises an enclosing member 101 with a slot 102 running longitudinally along the axis of the cylindrical member. The enclosing member 101 of the Golf Grip Seating Tool may be manufactured from rubber or any other suitable elastic material, so long as the material can be shaped to form an enclosing member. The enclosing member 101 ensures the temperature of the grip is maintained at ambient temperature since any extra heat in the grip due to air from the air compressor is transferred from the grip to the enclosing member 101 by conduction. The slot 102 running longitudinally facilitates heat exchange between ambient air and air in the grip. Moreover, the material preferably does not chemically react to the material of the grip.

A convergent nozzle 103 is mounted medially in the closed end of the enclosing member 101. The open end of the convergent nozzle 103 is inserted into the mating hole of the golf club grip. The closed end of the enclosing member 101 receives air from an air compressor.

Figure 2:
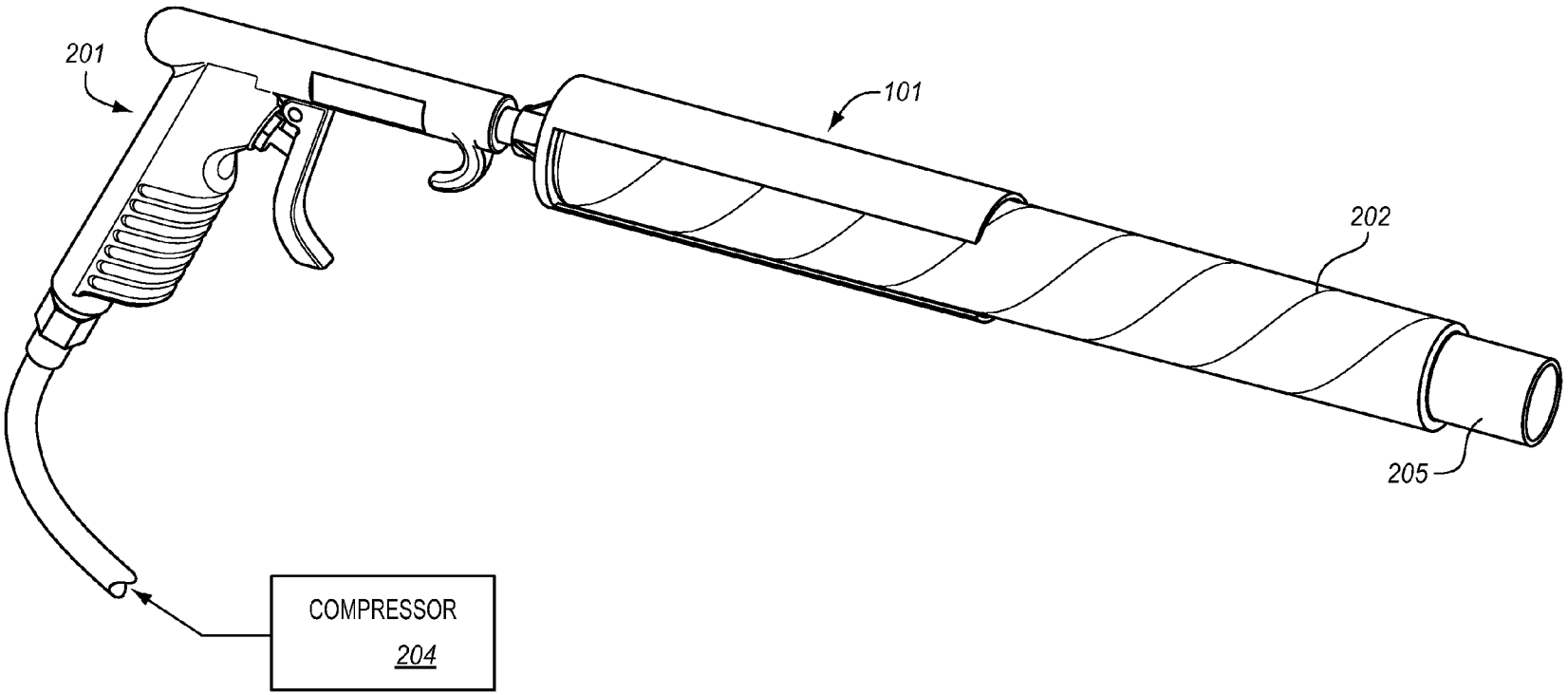
FIG. 2 is a drawing of a Golf Grip Seating Tool seating a grip on the shaft of a golf club.

FIG. 2 illustrates the exemplary attachment of an air gun 201 and grip 202 to the Golf Grip Seating Tool 101. The air gun 201 is connected to an air compressor 204 or other source of compressed gas. An exemplary air gun 201 includes a commercially available blow gun with screw-on adaptor. An exemplary air compressor 204 includes a commercially available air compressor set to feed air at a pressure of between 30 psi and 200 psi. An air compressor delivering less than 30 psi of air pressure does not require special training or permit to operate. The closed end of the enclosing member 101 can be threaded 104 to allow an air gun 201 to be screwed into place or, alternatively, notches are located on the closed end of the enclosing member 101 to facilitate the attachment of snap-on air guns.

The Golf Grip Seating Tool prevents the air gun 201 from unexpectedly disconnecting from the grip 202 due to the force of the air pressure. When the grip 202 is attached to the tool, the enclosing member 101 of the tool tightly clasps the grip 202; and the convergent nozzle 103 is sealed to the mating hole of the grip 202. As air flows into the shaft 205 and grip 202, both the grip 202 and enclosing member 101 expand. The enclosing member 101 and the grip 202 are clasped together by friction, preventing a sudden burst of air from detaching the grip 202 from the tool.

The enclosing member 101 of the tool may be cylindrical, since the Rules of Golf published by the governing bodies of golf require that all golf clubs with the exception of putters must have a circular cross section. However, a putter may have circular or rectangular cross-sections. Therefore, alternatively, the enclosing member 101 may be oval shaped or rectangular. The Golf Grip Seating Tool allows the seating of a grip 202 directly over an uncovered shaft 205 or over a shaft 205 with preexisting layers of tape.

Grip size can be a critical element in club fitting and performance. There is no one grip that is right for all golfers, and grip selection varies widely with individual needs and preferences. Golf grips are made in several sizes, for example, undersize, midsize, jumbo, women's standard, women's midsize, and women's undersize. The slot allows the diameter of the tool to increase without affecting the cylindrical shape. One wrap of tape can increase the grip size by 1/64 inches. Therefore, the Golf Grip Seating Tool allows a golfer to tailor the grip size by either seating an oversized grip or to layer tape on the shaft prior to seating the grip.

The nozzle 103 is a convergent (tapered) nozzle. As the compressed air flows through the narrowing neck of nozzle 103, the velocity of the compressed air increases continuously until it reaches a maximum value in the throat. Therefore, the convergent nozzle accelerates air received from the air compressor 204.

Figure 3:
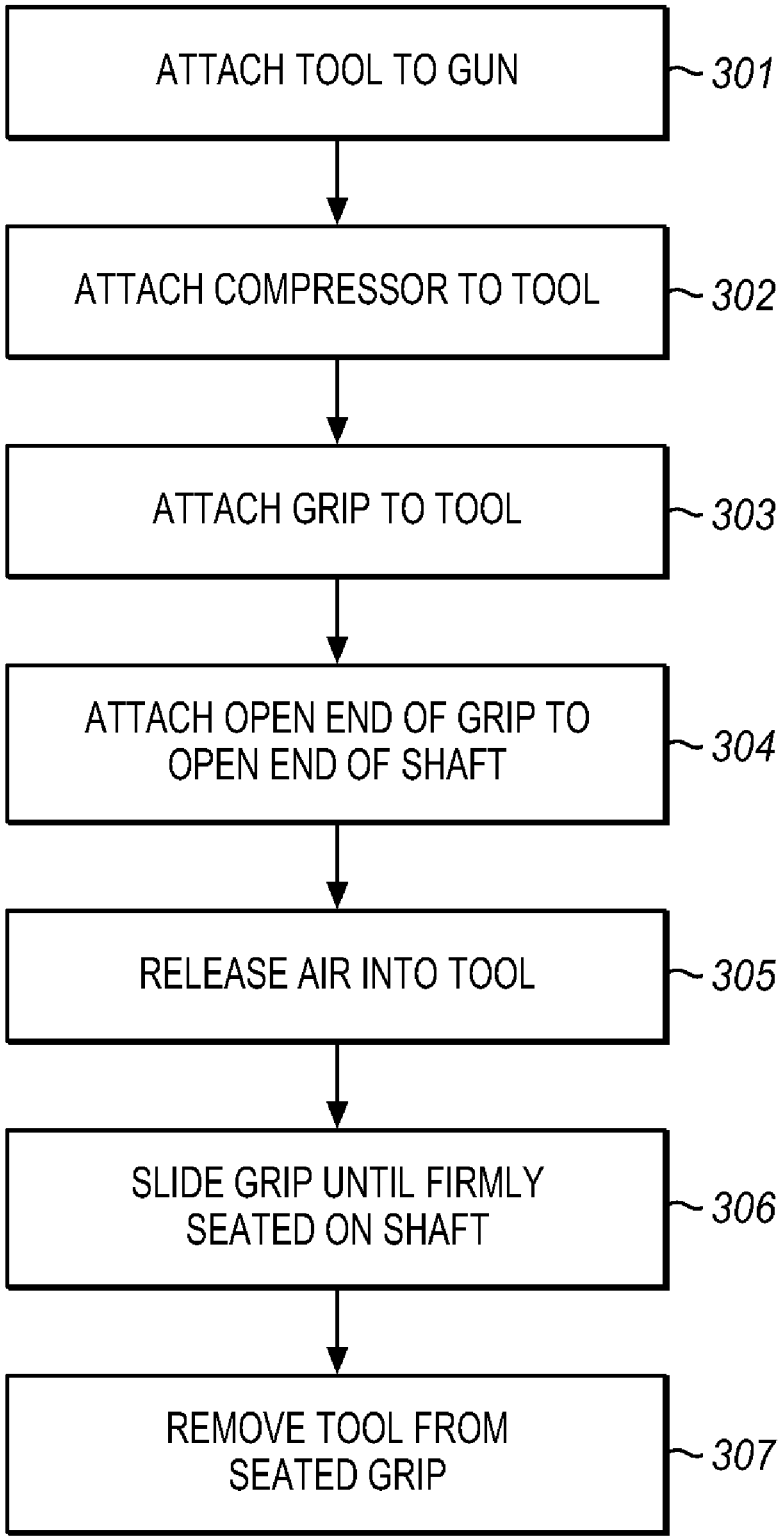
FIG. 3 is a flow chart showing a method of seating a grip on the shaft of a golf club using the Golf Grip Seating Tool.

FIG. 3 is a flow chart illustrating the use of the Golf Grip Seating Tool to seat a grip on the shaft of a golf club. The Golf Grip Seating Tool is first attached to the air gun 201 at step 301, which is itself attached to the air compressor 204 at step 302. The closed end of an unexpanded grip 202 then is inserted into the Golf Grip Seating Tool at step 303 by sliding the grip 202 into the enclosing member 101 until the nozzle 103 of the tool is fully inserted into the mating hole of the grip 202. The closed end of a grip 202 may hang loosely or in some cases bend over the open end edge of the shaft 205 when the grip 202 is initially inserted onto the shaft 205. The enclosing member 101 stiffens the closed end of the grip 202 preventing excessive force being applied by the user in pushing the grip 202 onto shaft 205 from deforming the grip 202. The open end of the grip 202 is attached to the open end of the shaft 205 of a golf club at step 304. The operator of the tool releases compressed air into the Golf Grip Seating Tool at step 305 by pulling the trigger of the air gun 201 and slides the grip 202 on the shaft 205 until the grip 202 is firmly seated on the shaft 205 at step 306. When air is blown into the mating hole of the closed end of the grip 202, air flows first into the shaft 205 of the club. When the shaft 205 is full of air, the air flows into the section of the grip 202 nearest to the closed end of the grip 202 and also into the space between the open end portion of the grip 202 already seated and the shaft 205. The section of the grip 202 nearest to the closed end traps most of the air; and if this air is not controlled, the grip 202 may be deformed. The last two steps can be combined into one step. Alternatively, these steps can be repeated while the grip 202 is incrementally seated on the shaft 205. The Golf Grip Seating Tool then is removed from the grip 202 at step 307 by twisting the tool and removing the grip 202 from the enclosing member 101 of the tool.

Once the grip 202 is fully seated on the shaft 205 and the tool is removed, the grip 202 tightly seals to the outer surface of the shaft 205. Friction prevents the grip 202 from any movement on the shaft 205, and the grip 202 is ready for use.

Longitudinal Slot Characteristics

The slot 102 running longitudinally along the axis of the enclosing member 101 of the tool can have beveled longitudinal edges that form a seal to allow the compressed air to expand the grip 202 yet allow excess air to escape as the grip 202 controllably inflates. The edges are angled such that rotating the enclosing member 101 causes increased contact between the grip 202 and the edge. A rotation in either direction of the enclosing member 101 rotates the grip 202 in that direction, therefore allowing for the repositioning of the grip 202 on the shaft 205.

The slot 102 also allows the user to see the portion of the underlying grip 202 that is exposed through the slot. Many grips are stamped with marks to facilitate the proper alignment of the grip on the shaft. Therefore, the user of the tool is able to maintain sight of the alignment marks on the grips while operating the tool.

The slot 102 also prevents air flowing into the shaft 205 and grip 202 from deforming the grip by allowing the grip to expand but only to the extent of the diameter of the tool. The slot 102 causes the diameter of the enclosing member 101 to be adjustable by allowing the diameter of the enclosing member 101 to increase when pressure is applied from inside the enclosing member. The slot 102 allows the elasticity of the enclosing member 101 to be controlled by reducing the total area of elastic material. Therefore, even though the enclosing member 101 is made from material different from that of the grip 202, the enclosing member 101 may be configured to have an elastic limit equivalent to that of the grip 202.

The air flowing into the shaft 205 and the grip 202 increases the pressure against the inside surface of the enclosing member 101, widening the diameter of the enclosing member 101. The diameter of the enclosing member 101 decreases when the pressure against the inside surface of the enclosing member 101 is reduced. In an embodiment, the pressure may be reduced when the air gun 201 trigger is released. The diameter of the enclosing member 101 returns to its unexpanded state when the air flow is terminated.

The slot 102 of the enclosing member 101 controls the regulation of air pressure in the shaft 205 and grip 202. As explained above, the slot 102 running longitudinally along the axis of the enclosing member 101 of the tool allows the grip 202 to expand but only to a limit. In one embodiment, this limit is ten percent greater than the diameter of the grip. In another embodiment, this limit is the elastic limit of the material of the grip. As air is fed into the shaft 205 and grip 202, the grip expands to the limit of the enclosing member 101 of the tool forming a gap between the grip 202 and the outer surface of the shaft 205 underneath. When the grip 202 is fully expanded to the maximum diameter of the enclosing member 101, excess air flows through the gap and is expelled from the open end of the grip. Therefore, the maximum volume of space into which air can flow, that is, the volume of the shaft 205 and volume of the space bounded by the grip 202 and outer surface of the shaft 205, is determined by the maximum diameter and the length of the enclosing member 101 of the tool.

The tool's controllable regulation of air pressure prevents the unintended excess application of air pressure that can deform a grip 202. Moreover, since the user no longer has to readjust the air pressure by repeatedly turning the air compressor valve, the user can complete the seating of the grip 202 in 25% less time compared to what is known in the art.

The length of the enclosing member 101 may be, but is not limited to, a length one-half the length of the grip 202. The length of the enclosing member 101, as previously explained, affects the regulation of air pressure inside the grip 202. Additionally, the length of the enclosing member 101 also affects the amount of resistance that can be applied to the grip 202, since the area of the inside surface of the enclosing member 101 is proportional to the length of the grip 202. A frictional force is applied to the grip 202 when the grip 202 is expanded fully to the maximum diameter of the enclosing member 101.

The Golf Grip Seating Tool allows easy alignment of the grip 202. When the grip 202 is expanded to the limiting diameter of the enclosing member 101 of the tool, the part of the grip 202 enclosed by the enclosing member 101 of the tool is in friction with the enclosing member 101. Air that flows between the grip 202 and the outer surface of the shaft 205 acts as a lubricant, allowing the user to align the grip 202 to a desirable position by turning the tool.

When removing a worn or frayed grip, the diameter and length of the enclosing member 101 together with the slot 102 combine to provide the resistance force to allow the user to perform the removal by turning the tool. As explained above, the air flow inside the grip 202 provides the lubrication and the friction between the grip 202 and the enclosing member 101 when the grip is expanded to the limiting diameter of the enclosing member providing the resistive force.

There has been described a tool for the seating of a grip on the shaft of a golf club. It should be understood that the particular embodiments shown in the drawings and described within this specification are for purposes of example and should not be construed to limit the invention, which will be described in the claims below. Further, it is evident that those skilled in the art may now make numerous uses and modifications of the specific embodiment described without departing from the inventive concepts. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the apparatus and methods described.

It should also be noted that ratios, concentrations, amounts, and other numerical data may be expressed herein in a range format. It is to be understood that such a range format is used for convenience and brevity; thus, it should be interpreted in a flexible manner to include not only the numerical values explicitly recited as the limits of the range but also to include all of the individual numerical values or sub-ranges encompassed within that range as if each numerical value and sub-range is explicitly recited.

What is claimed as new and desired to be protected by Letters Patent of the United States is:

1. A tool for seating a flexible golf grip having a closed end and an open end to a mating and correspondingly shaped golf shaft comprising:

an enclosing member having an axial bore with an open end and a closed end;

wherein said enclosing member has a longitudinal slot extending along the axis of said enclosing member wherein said slot runs along the side of said enclosing member from said open end of said enclosing member at least part of the way to said closed end of said enclosing member thereof:

a nozzle having a first end and second end mounted medially in said closed end of said enclosing member and wherein said second end of said nozzle is connected to an aperture formed in said closed end of said enclosing member;

wherein said first end of said nozzle is insertable into a mating hole in a closed end of said golf grip; and wherein said closed end of said enclosing member having threads and is connectable to a source of compressed air.

2. The tool of claim 1 wherein said enclosing member is cylindrically shaped.

3. The tool of claim 1 wherein said enclosing member is oval shaped.

4. The tool of claim 1 wherein said enclosing member is rectangularly shaped.

5. The tool of claim 1 wherein said tool is configured to receive air from said source of compressed air comprising an air compressor rated at between 20 psi to 200 psi.

6. The tool of claim 1 wherein the enclosing member is made from an elastic material.

7. The tool of claim 1 wherein said enclosing member is at least one-half the length said golf grip.

8. The tool of claim 1 wherein said enclosing member has a diameter at least 10% greater than the diameter of said golf grip.

9. The tool of claim 1 wherein said enclosing member has an adjustable diameter to allow said golf grip to expand but less than exceeding the elastic limit of said golf grip.

10. The tool of claim 1 wherein said enclosing member has an adjustable diameter to allow said golf grip to expand but prevents lateral deformation of said golf grip.

11. The tool of claim 1 wherein said tool automatically regulates air pressure applied by having a dimension at an open end which enables air to escape between said golf grip and said golf shaft.

12. The tool of claim 1 wherein said open end of said golf grip is inserted onto said mating golf shaft; wherein said closed end of said golf grip is inserted into said open end of said enclosing member; wherein said first end of said nozzle is inserted into said mating hole of said golf grip; wherein said closed end of said enclosing member is connected to the source of compressed air and is operable to fill said golf shaft and said golf grip with air.

* * * * *